US009415969B2

(12) United States Patent
Fritsch et al.

(10) Patent No.: US 9,415,969 B2
(45) Date of Patent: Aug. 16, 2016

(54) METHOD FOR CONTROLLING A FEEDER OF A GATHERING-STITCHING MACHINE

(71) Applicant: MUELLER MARTINI HOLDING AG, Zofingen (CH)

(72) Inventors: Stephan Fritsch, Frauenfeld (CH); Steffen Hoffmann, Leipzig (DE); Falk Preuss, Leipzig (DE)

(73) Assignee: Mueller Martini Holding AG, Zofingen (CH)

( * ) Notice: Subject to any disclaimer, the term of this patent is extended or adjusted under 35 U.S.C. 154(b) by 0 days.

(21) Appl. No.: 13/714,709

(22) Filed: Dec. 14, 2012

(65) Prior Publication Data

US 2013/0154177 A1 Jun. 20, 2013

(30) Foreign Application Priority Data

Dec. 14, 2011 (DE) ..... 10 2011 120 994

(51) Int. Cl.

| | |
|---|---|
| ***B65H 5/12*** | (2006.01) |
| ***B65H 39/00*** | (2006.01) |
| ***B42C 1/12*** | (2006.01) |

(Continued)

(52) U.S. Cl.

CPC *B65H 39/00* (2013.01); *B42B 4/00* (2013.01); *B42B 9/02* (2013.01); *B42B 9/04* (2013.01); *B42C 1/12* (2013.01); *B65H 3/0875* (2013.01); *B65H 5/307* (2013.01); *B65H 5/32* (2013.01); *B65H 39/043* (2013.01); *B65H 39/055* (2013.01); *B65H 2301/322* (2013.01); *B65H 2511/415* (2013.01); *B65H 2513/50* (2013.01); *B65H 2701/1932* (2013.01)

(58) Field of Classification Search

CPC ..... B42B 4/00; B65H 5/12
USPC ..... 270/52.14, 52.15, 52.16, 52.17, 52.18, 270/52.19, 52.2, 52.21, 52.22, 52.23, 52.24, 270/52.25, 52.26, 52.27, 52.28, 52.29, 52.3, 270/56

See application file for complete search history.

(56) References Cited

U.S. PATENT DOCUMENTS 4,078,784 A * 3/1978 Miaskoff et al. ..... 270/56
4,162,066 A * 7/1979 McCain et al. ..... 271/5

(Continued)

FOREIGN PATENT DOCUMENTS

DE 1 100 043 B 2/1961
DE 42 21 929 C2 11/1997

(Continued)

OTHER PUBLICATIONS

German Patent and Trademark Office Search Report Dated Nov. 8, 2012.

*Primary Examiner* — Patrick Mackey
(74) *Attorney, Agent, or Firm* — Laurence A. Greenberg; Werner H. Stemer; Ralph E. Locher

(57) ABSTRACT

A method for controlling a feeder of a gathering-stitching machine reduces the operating effort when setting the feeder, increases reliability when laying folded sheets on a transport device and improves quality during collating and stitching. Opening and closing times of grippers are regulated under program control, continuously and as a function of format when controlling the feeder of the gathering-stitching machine. Data relating to the dimensions and to the number of pages of the folded sheets is thus entered into a control device, from which data actuating signals for actuating elements of the grippers are generated.

9 Claims, 6 Drawing Sheets

(51) Int. Cl.

| | |
|---|---|
| ***B42B 4/00*** | (2006.01) |
| ***B42B 9/02*** | (2006.01) |
| ***B42B 9/04*** | (2006.01) |
| ***B65H 3/08*** | (2006.01) |
| ***B65H 5/30*** | (2006.01) |
| ***B65H 5/32*** | (2006.01) |
| ***B65H 39/043*** | (2006.01) |
| ***B65H 39/055*** | (2006.01) |

(56) References Cited

U.S. PATENT DOCUMENTS

| | | | | | |
|---|---|---|---|---|---|
| 4,844,433 | A * | 7/1989 | Hastie | 270/52.27 | |
| 5,029,832 | A * | 7/1991 | Orsinger et al. | 270/58.06 | |
| 5,042,232 | A * | 8/1991 | Orsinger et al. | 53/460 | |
| 5,333,547 | A * | 8/1994 | Pfisterer | B65H 5/14 | 101/232 |
| 5,390,601 | A * | 2/1995 | Fricke | B41F 21/10 | 101/409 |
| 5,447,302 | A * | 9/1995 | Curley | B65H 5/14 | 271/11 |
| 5,518,231 | A * | 5/1996 | Reddy | B65H 5/14 | 271/204 |
| 5,893,824 | A * | 4/1999 | Schlough | B65H 5/12 | 270/52.27 |
| 6,175,775 | B1 | 1/2001 | Grunder | | |
| 7,234,694 | B2 * | 6/2007 | Richter et al. | 270/52.26 | |
| 7,451,969 | B2 * | 11/2008 | Bottcher | B42B 4/00 | 270/52.14 |
| 7,510,184 | B2 * | 3/2009 | Kaya | B65H 5/12 | 271/176 |
| 7,748,517 | B2 * | 7/2010 | Caunter | B65H 5/12 | 198/468.2 |
| 7,812,853 | B2 * | 10/2010 | Altenbach | B41F 21/12 | 347/236 |
| 8,061,702 | B2 * | 11/2011 | Caunter | 270/52.26 | |
| 2007/0228633 | A1 * | 10/2007 | Hoffmann | B42B 9/02 | 270/52.25 |
| 2013/0285306 | A1 * | 10/2013 | Zuech et al. | 271/10.09 | |

FOREIGN PATENT DOCUMENTS

| | | | |
|---|---|---|---|
| DE | 197 52 015 | A1 | 5/1999 |
| DE | 198 41 265 | A1 | 3/2000 |
| EP | 0 749 927 | A1 | 12/1996 |
| EP | 0917965 | A1 | 5/1999 |
| EP | 1525998 | A2 | 4/2005 |

* cited by examiner

FIG. 5.1
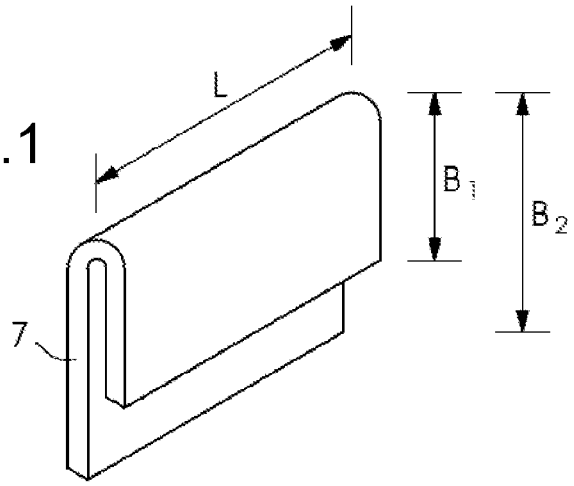
FIG. 5.2
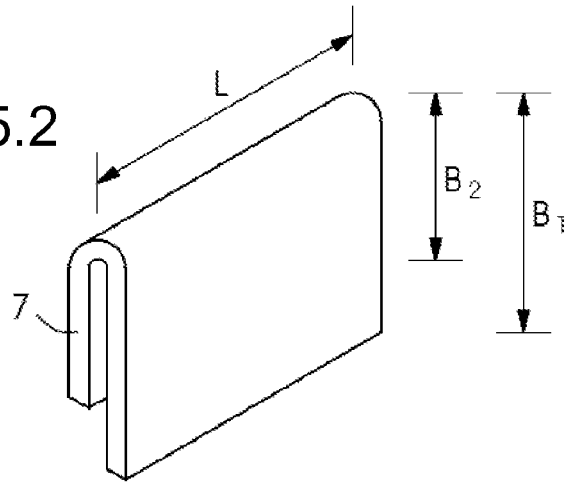
FIG. 5.3
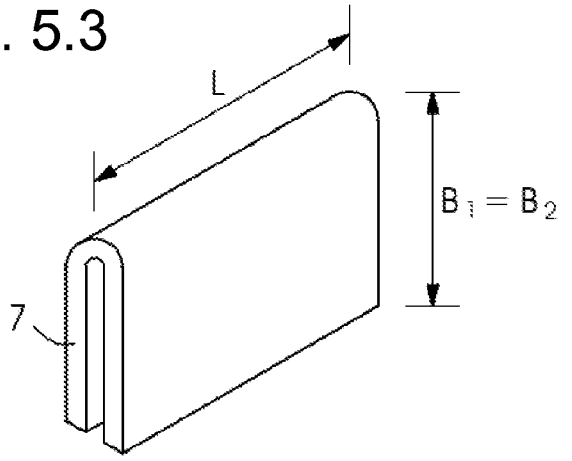

METHOD FOR CONTROLLING A FEEDER OF A GATHERING-STITCHING MACHINE

CROSS-REFERENCE TO RELATED APPLICATION

This application claims the priority, under 35 U.S.C. §119, of German Patent Application DE 10 2011 120 994.1, filed Dec. 14, 2011; the prior application is herewith incorporated by reference in its entirety.

BACKGROUND OF THE INVENTION

Field of the Invention

The invention relates to a method for controlling a feeder of a gathering-stitching machine, in which folded sheets are separated one after another by at least one gripper from a stack of a magazine and laid on a transport device, and opening and closing the gripper and actuating a stitching device are carried out under remote control by actuating signals from a control device.

German Published, Prosecuted Patent Application DE 1 100 043 discloses a gripper for a bookbinding machine for gripping and firmly holding sheets, the closing movement of which is initiated by actuating a pneumatic operating cylinder. If the operating cylinder is placed under vacuum or pressurized with compressed air, then a gripper finger fixed to a piston rod is drawn-in counter to the force of a spring. The pressurized or vacuum air is fed to the operating cylinder through a control valve, which is controlled by an adjustable cam disk in such a way that the gripper force is regulated. A cam disk has a fixed actuating characteristic corresponding to the cam curve. No details relating to the adjustment of the cam disk are disclosed in that application.

In printing presses, it is also known from German Patent DE 42 21 929 C2, corresponding to U.S. Pat. No. 5,390,601, to control the movement of grippers connected to a drum by using a computer, so that rapid adaptation to changing operating conditions is possible, and the gripper force can be set as a function of the printing material. The gripper movements are controlled with a pneumatic piston-cylinder unit, with the actuating position of the piston being regulated with the aid of a displacement measuring system as a function of the rotational angle of the drum, through the use of a set point/actual comparison. In the patent, there is no more detailed explanation as to which printing material characteristic variables play a role in calculating actuating positions of the piston.

A gatherer-stitcher described in German Published, Non-Prosecuted Patent Application DE 197 52 017 A1 includes a plurality of folded sheet feeders. The rotational speed of the drums of a feeder can be retarded or accelerated, depending on the paper quality, with the speed of a gatherer chain being uniform.

A gatherer-stitcher described in German Published, Non-Prosecuted Patent Application DE 198 41 265 A1 reveals the provision of sensors which measure the length and width of the folded sheets in a feeder of the gatherer-stitcher. A register stop can be set automatically by using the sensor signals. The grippers holding the folded sheets during a delivery are conventionally actuated through the use of a cam mechanism.

SUMMARY OF THE INVENTION

It is accordingly an object of the invention to provide a method for controlling a feeder of a gathering-stitching machine, which overcomes the hereinafore-mentioned disadvantages of the heretofore-known methods of this general type, which reduces the operating effort when setting the feeder, which increases the reliability when laying folded sheets on a transport device and which improves the quality during collating and stitching.

With the foregoing and other objects in view there is provided, in accordance with the invention, a method for controlling a feeder of a gathering-stitching machine. The method comprises separating folded sheets one after another from a stack of a magazine using at least one gripper, laying the separated folded sheets on a transport device, opening and closing the at least one gripper and actuating a stitching device under remote control using actuating signals from a control device, and generating the actuating signals from data relating to dimensions and number of pages of the folded sheets.

According to the invention, when controlling a feeder of a gathering-stitching machine, the opening and closing times of grippers are regulated under program control, continuously and as a function of format. For this purpose, data relating to the dimensions and to the number of pages of the folded sheets is entered into a control device, from which data actuating signals for actuating elements of the grippers are generated. As a result of the automated separation of folded sheets, it is possible to vary the switching and reaction times on a product basis. When pneumatic controllers are used, the number of mechanical components can be reduced, so that low production costs arise. As a result of a low number of mechanical wearing points, the reliability of the feeder is improved. Marks on the folded sheets can be avoided, in that the gripping forces can be set variably.

Other features which are considered as characteristic for the invention are set forth in the appended claims.

Although the invention is illustrated and described herein as embodied in a method for controlling a feeder of a gathering-stitching machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIGS. 5.1-5.3 are perspective views of folded sheets and dimensions thereof.

DETAILED DESCRIPTION OF THE INVENTION

Figure 1:
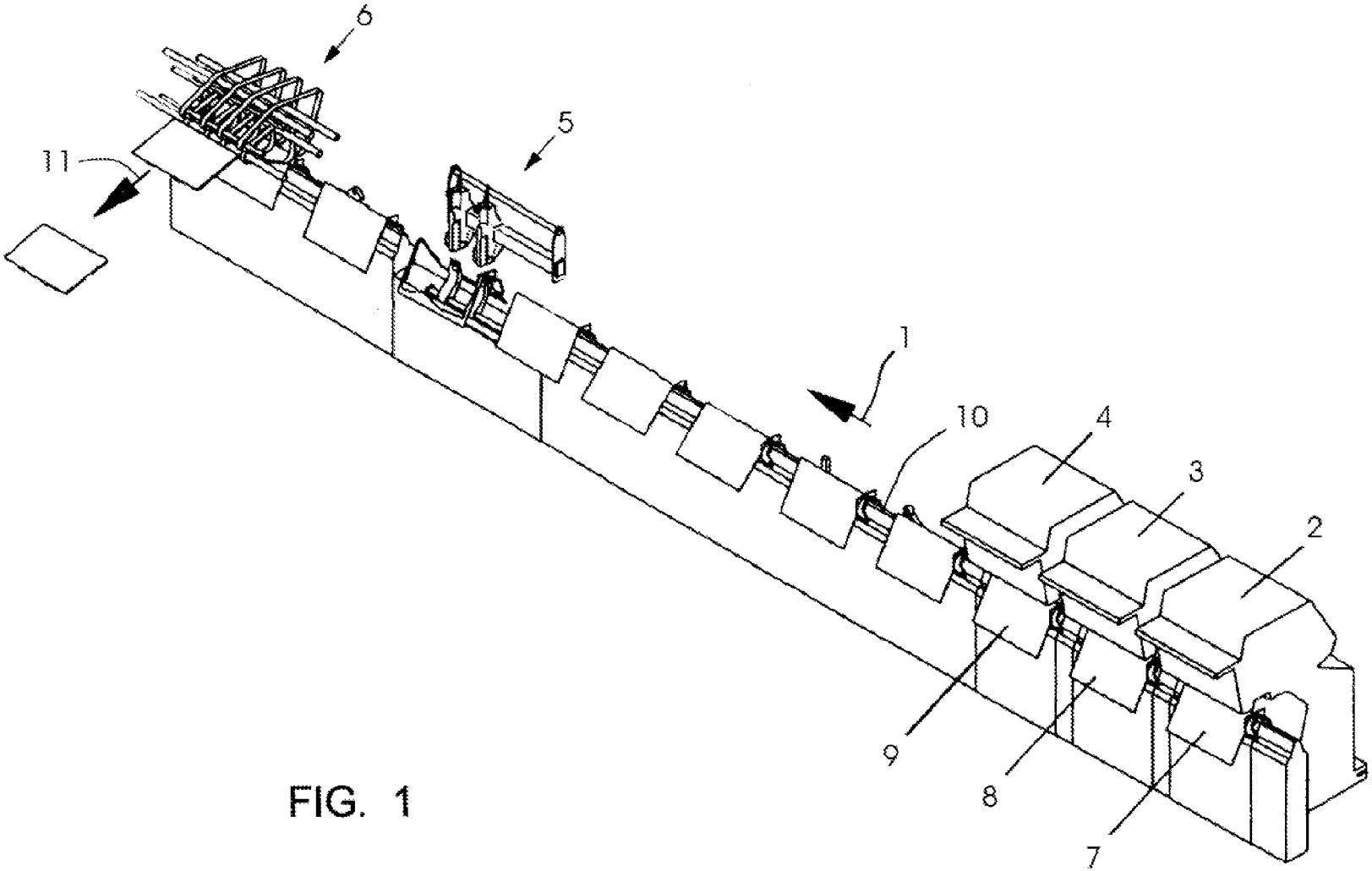
FIG. 1 is a diagrammatic, perspective view of a gathering-stitching machine having a plurality of feeders.

Referring now to the figures of the drawings in detail and first, particularly, to FIG. 1 thereof, there is seen a gathering-stitching machine which includes, inter alia, three feeders 2-4 disposed one after another in a production direction 1, a stitching station 5 and a cross-conveyor 6. Folded sheets 7-9 which are separated in the feeders 2-4 are laid one above another astride on an endlessly circulating gathering chain 10 and are conveyed to the stitching station 5. In the stitching station 5, the collated folded sheets 7-9 are joined to one another by spine wire stitching. After the cross-conveyor 6, the folding sheets 7-9 which are joined to one another are given a new production direction 11 for onward transport to a trimmer.

Figure 2:
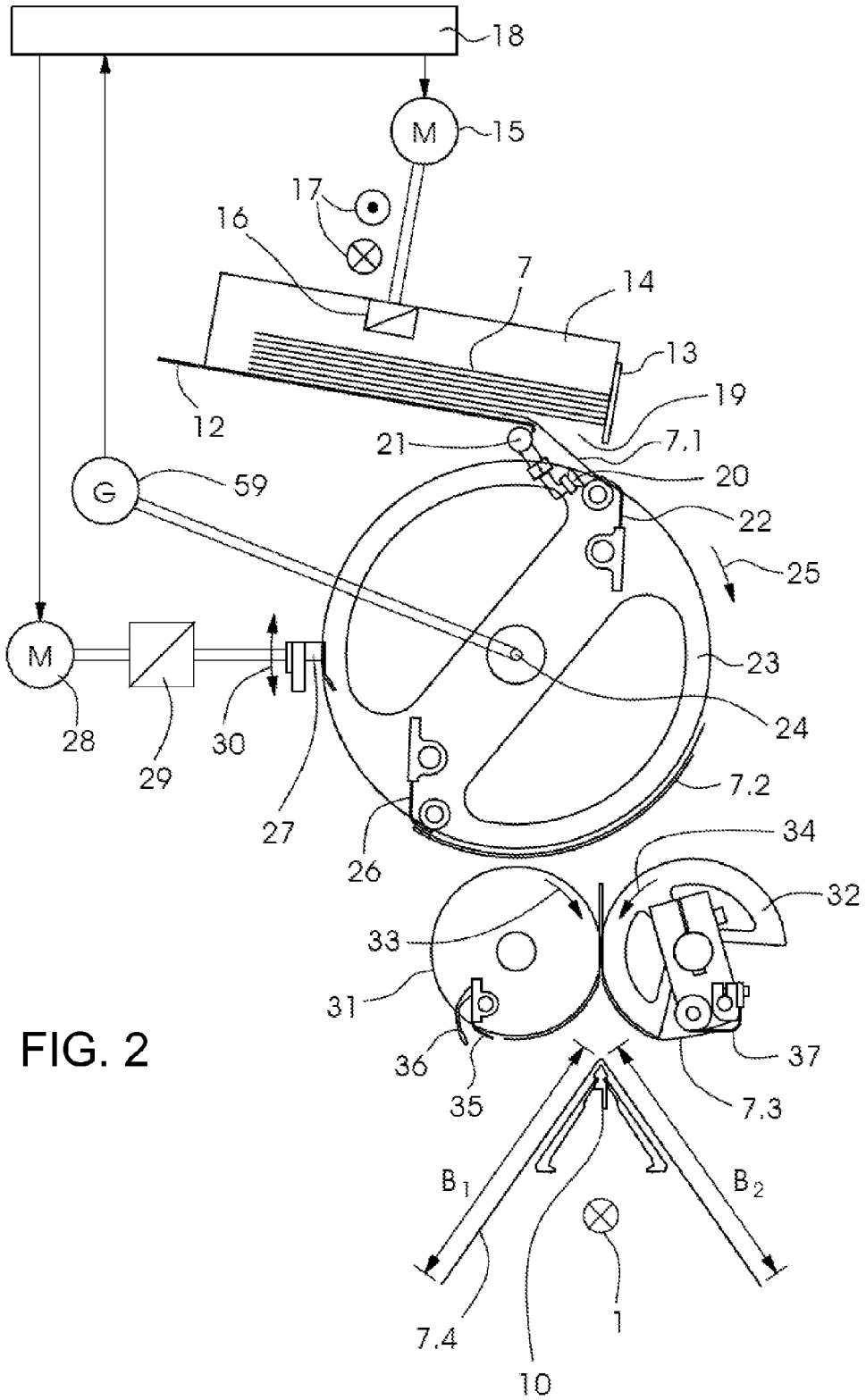
FIG. 2 is a cross-sectional view of a feeder.

As is seen from the sectional illustration of the feeder 3 in FIG. 2, folded sheets 7 are located in such a way as to be stacked one above another in a magazine 12. The base of the magazine 12 lies at an angle to the horizontal. The folded sheets 7 rest with their folded leading edges on a register rail 13 and with their side edges on lateral edge stops 14. The lateral stops 14 can be set to a spine length L of the folded sheets 7 through the use of a motor 15 and a spindle drive 16 in a direction 17 at right angles to the plane of the sheet. The motor 15 is connected to a control device 18.

In order to separate the folded sheets 7 from the underside of the folded sheet stack, suction grippers 20 are disposed underneath an opening 19 in the base of the magazine 12. The suction grippers 20 are fixed to a hollow shaft 21 and can be pivoted about an axis of the hollow shaft 21 at a separation cycle rate.

FIG. 2 illustrates a situation in which a separated folded sheet 7.1 has been transferred from the suction grippers 20 into mechanical grippers 22 of a separating drum 23. The separating drum 23 rotates about its shaft 24 in a direction 25. A folded sheet 7.2 preceding the separated folded sheet 7.1 is held in further mechanical grippers 26 of the separating drum 23. The grippers 26 are located diametrically opposite the grippers 22 in relation to the shaft 24.

During a further rotation of the separating drum 23 in the direction 25, the folded sheet 7.2 comes with its leading edge against a pocket-like stop 27. The stop 27 can be pivoted about the shaft 24 in a direction 30 in a manner corresponding to folded sheet widths B1, B2 by a motor 28 and a gearbox 29. The motor 28 is connected to the control device 18.

Two further drums 31, 32, which are disposed underneath the separating drum 23, rotate in opposite directions as shown by the direction of arrows 33, 34. FIG. 2 shows a situation in which a folded sheet 7.3 preceding the folded sheet 7.2 is opened through the use of the drums 31, 32. While the folded sheet 7.3 lies with its leading edge against the stop 27, the ends of the folded sheet 7.3 running after it on the separating drum 23 were gripped by double grippers 35, 36 of the drum 31. The lap of the folded sheet 7.3 has been transferred from the top grippers 36 to grippers 37 of the opener drum 32. The folded sheet 7.3 is drawn apart at the ends and allowed to fall over the gathering chain 10. The folded sheet 7.3 is laid over a folded sheet 7.4, which has already been laid on the gathering chain 10 through the use of the feeder 2.

Figure 3:
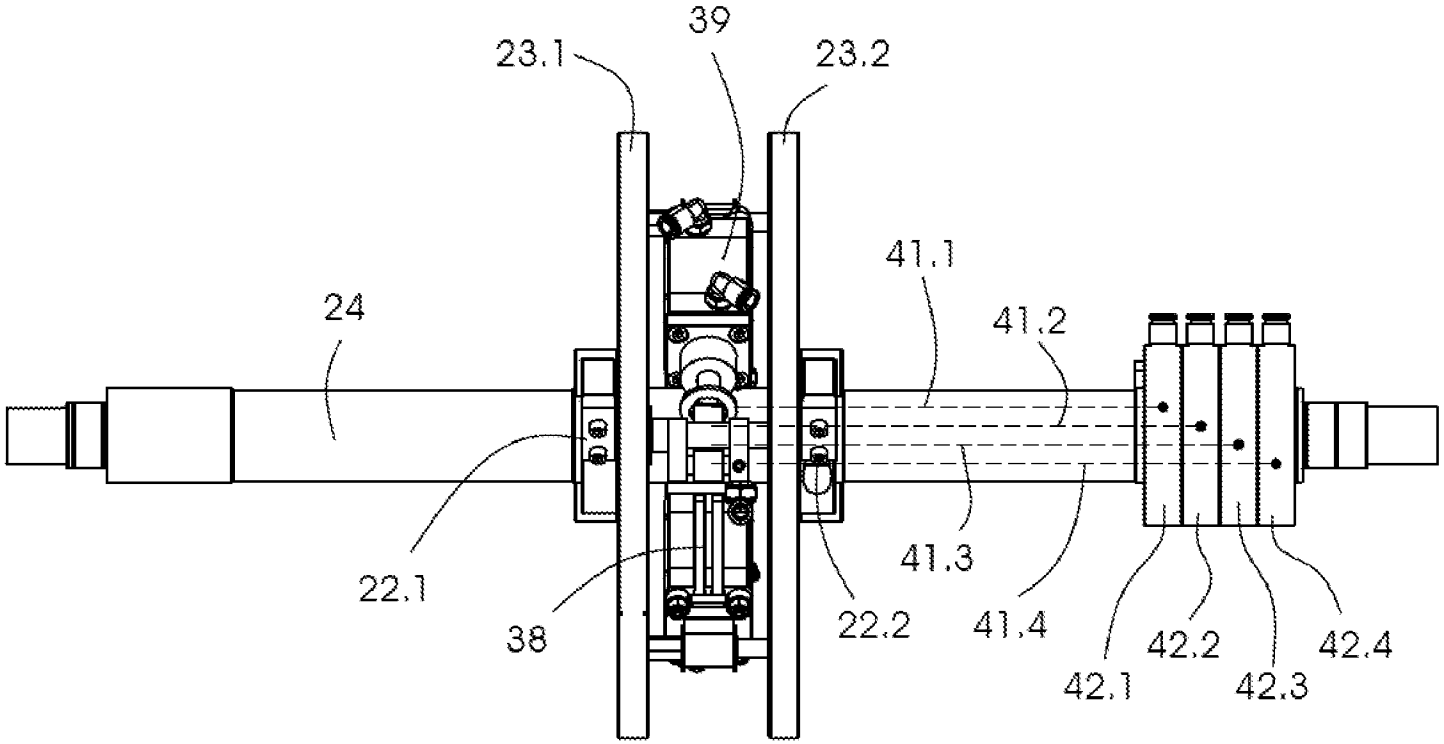
FIG. 3 is a side-elevational view of a separating drum with pneumatic operating cylinders.
Figure 4:
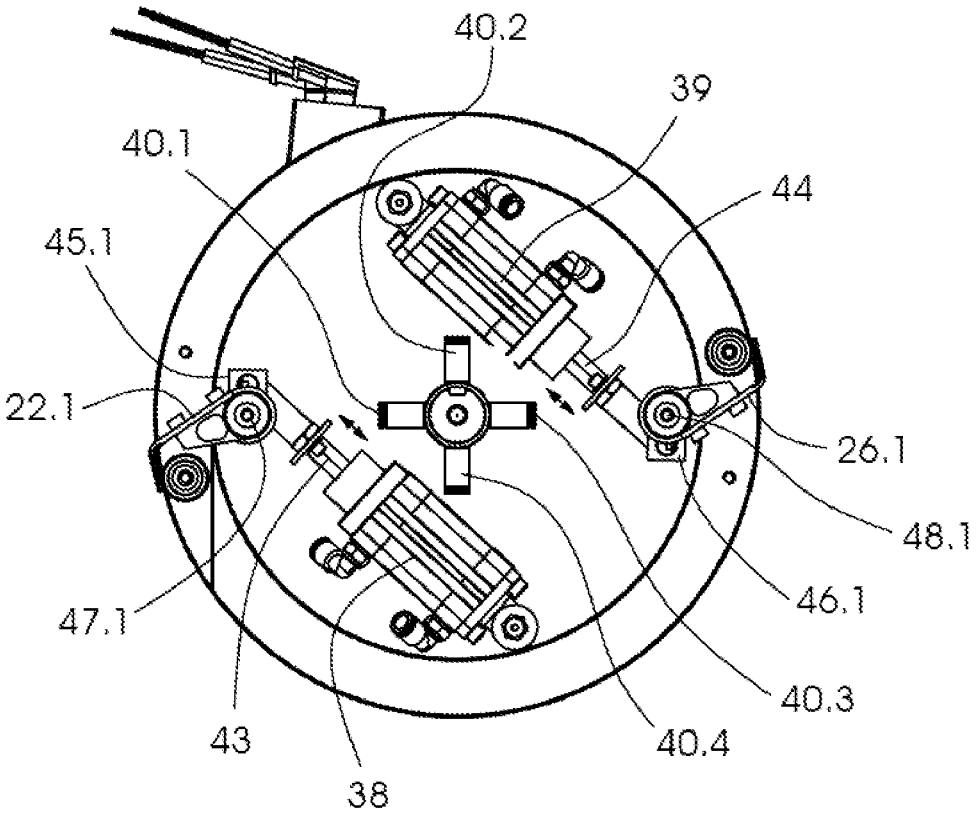
FIG. 4 is a cross-sectional view showing a pair of grippers of a separating drum, operated by operating cylinders.

FIGS. 3 and 4 show a pneumatic controller of the movement of the grippers 22, 26 of the separating drum 23. The separating drum 23 includes two drum disks 23.1, 23.2, which are seated in a rotationally fixed manner on the hollow shaft 24. Disposed between the disks 23.1, 23.2 are pneumatic operating cylinders 38, 39, from each of which two respective pneumatic control lines 40.1-40.4 lead to channels 41.1-41.4 in the interior of the shaft 24. A supply of compressed air for the operating cylinders 38, 39 is carried out through rotary lead-throughs 42.1-42.4, each disposed at the end of a respective channel 41.1-41.4. Operating piston rods 43, 44 of the operating cylinders 38, 39 are connected to levers 45.1, 45.2, 46.1, 46.2, which are seated in a rotationally fixed manner on gripper shafts 47.1, 47.2, 48.1, 48.2 of the grippers 22, 26. A pair of grippers 22.1, 26.1; 22.2, 26.2 is disposed on each disk 23.1, 23.2. As the piston rods 43, 44 are moved in and out of the operating cylinders 38, 39, the gripper shafts 47, 48 have a torque applied to them which effects closing and opening of the grippers 22, 26.

The grippers 22, 26 are opened and closed on the basis of the dimensions and the number of pages n of the folded sheets 7. Depending on whether a trailing fold sheet NF with $B_1<B_2$, (FIG. 5.1), a leading fold sheet VF with $B_1>B_2$ (FIG. 5.2) or a folded sheet with equal fold widths with $B_1=B_2$ (FIG. 5.3) is involved, the dimensions illustrated in FIG. 5 are taken into account. Further dimension-based data are the sheet thickness d and the grammage G.

Figure 6:
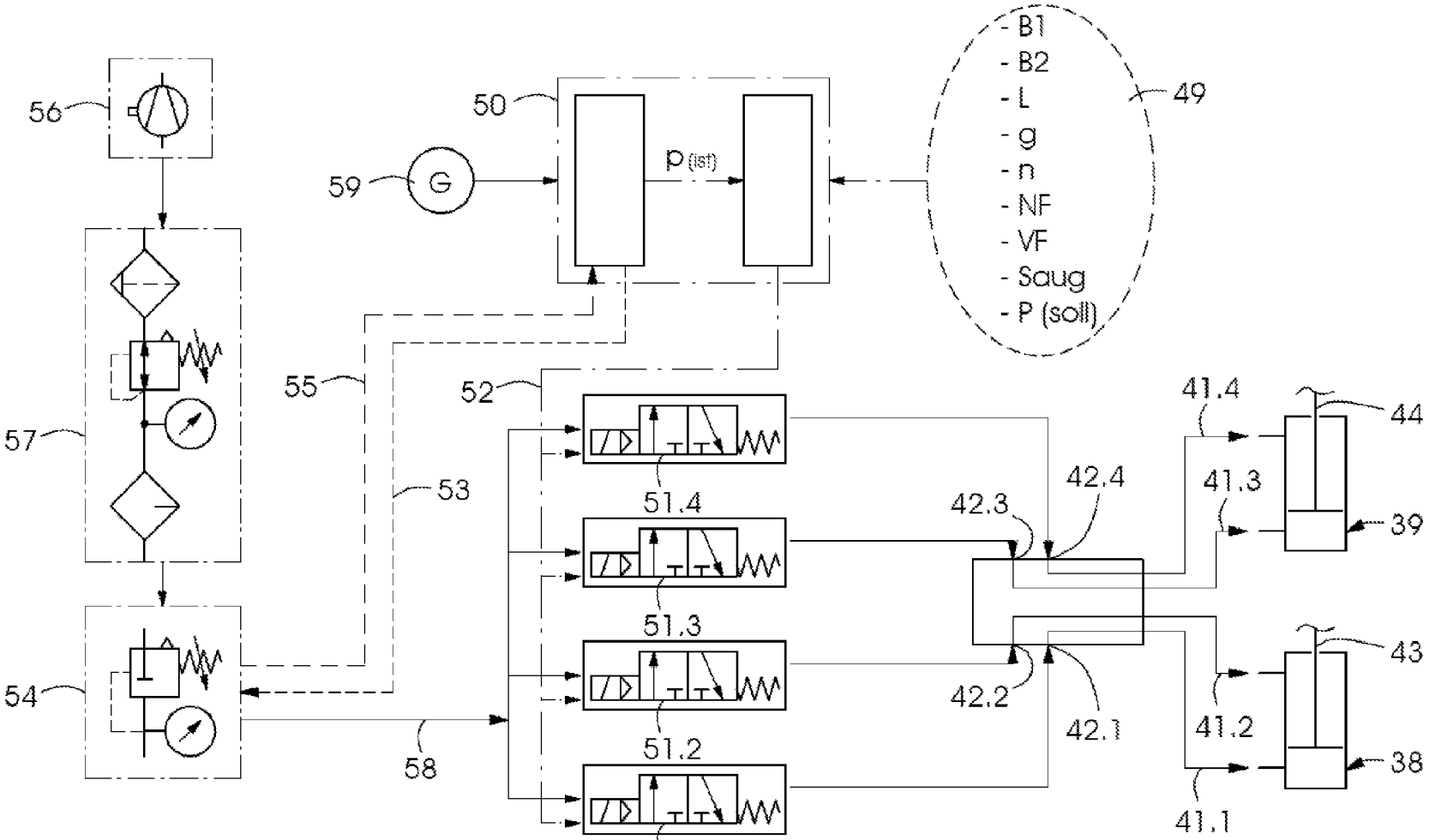
FIG. 6 is a schematic diagram of a control device for a feeder.

The performance of the method is to be described below by using the schematic diagram illustrated in FIG. 6:

The control device 18 includes, inter alia, an input device 49 for operator entries, which is connected to a computer 50. The computer 50 contains a memory for operator entries relating to the following variables: sheet width B1, sheet width B2, spine length L, grammage g, number n of pages, type of fold such as trailing fold sheet NF, leading fold sheet VF or sucker sheet suck, and pressure set point $p_{(sp)}$.

In the computer 50, the variables which are entered are processed and lead to pre-setting of various elements in the feeders 2-4. The spine length L results in a pre-setting of the side stops 14 on the magazine 12 by using the motor 15. The sheet width B2 leads to a pre-setting of the register stop 27 using the motor 28 and of the gripper opening angle $\alpha_o$ of the grippers 22, 26 on the separating drum 23. Both sheet widths B1, B2 are used in order to preset the gripper closing angle $\alpha_c$ of the grippers 35-37 on the drums 31, 32. The spine length L, the sheet widths B1, B2 and the sheet thickness d result in a pre-setting of a thickness monitoring device, a wire feed and a clincher tool belonging to the stitching station 5 and a height of a stepper belt. The gripping forces F of the grippers 22, 26 of the separating drum 23 are preset by using the sheet thickness d. The predefined pressure set point $p_{(sp)}$ exerts some influence in presetting the gripping force F and the switching time $t_{sw}$ of two-way valves 51.1-51.4, which are connected to the rotary lead-throughs 42.1-42.4. The switching time $t_{sw}$ of the valves 51.1-51.4 is controllable, for which purpose there is a connection 52 between the valves 51.1-51.4 and the computer 50.

The pressure set point $p_{(sp)}$ is transmitted through a connection 53 from the computer 50 to a pressure controller 54. The actual pressure $p_{(act)}$ is transmitted from the pressure controller 54 through a connection 55 to the computer 50, where a comparison with the pressure set point $p_{(sp)}$ is carried out continuously. If the pressure set point $p_{(sp)}$ and actual pressure $p_{(act)}$ agree, the switching time $t_{sw}$ remains constant. If $p_{(act)}>p_{(sp)}$, the switching time $t_{sw}$ required for this actual pressure $p_{(act)}$ is passed on to the valves 51.1 to 51.4. Furthermore, the information to reduce the pressure $p_{sp}$ is transmitted to the pressure controller 54. If $p_{(act)}<p_{(sp)}$ then the switching time $t_{sw}$ required for this pressure $p_{(act)}$ is likewise transmitted to the valves 51.1-51.4 and the information to increase the pressure to $p_{(sp)}$ is passed on to the pressure controller 54. With the aid of the pressure controller 54 and the feedback of $p_{(act)}$, it is possible to ensure that the gripper opening angles and gripper closing angles needed for sheet separation continually remain constant.

In addition to the $p_{(sp)}$ calculated in accordance with the program, provision is made that an operator can at any time during the operation manually predefine the desired positive pressure $p_{(sp)}$ individually for each feeder 2-4 without disrupting the running production. Following the manual intervention, the regular set point-actual comparison between $p_{(sp)}$ and $p_{(act)}$ is again carried out.

All of the settings and changes are stored in the computer 50. In the case of identical subsequent jobs, this data can be retrieved. This reduces the setup time, so that the operating costs are reduced.

The compressed air for actuating the grippers 22, 26 is provided by a pump 56, which is connected to the pressure controller 54 through a maintenance unit 57. The compressed air is provided from the pressure controller 54 to the valves 51.1-51.4 through a connection 58 which, in accordance with the two-way switching, passes on the compressed air through the rotary lead-throughs 42.1-42.4 to the operating cylinders 38, 39. The drive of the drums 23, 31, 32 is carried out synchronously through the use of the control device 18, with a rotary encoder 59 on the shaft 24 being used to output the current rotational speed and the current rotational angle a of the drum 23 to the control device 18 and to the computer 50.

The invention is not restricted to the exemplary embodiment described. Automatic control of the gripper movements can also be carried out for the grippers 35 to 37 of the drums 31 to 32. Instead of pneumatic actuating elements, it is also possible for electric or electromagnetic actuating elements to be used.

The invention claimed is:

1. A method for controlling a feeder of a gathering-stitching machine, the method comprising the following steps:

separating folded sheets one after another from a stack of a magazine using at least one gripper;

opening and closing the at least one gripper using actuating signals from a control device;

generating the actuating signals for opening and closing the at least one gripper from data relating to dimensions and number of pages of the folded sheets; and using a fold width dimension for setting a gripper opening angle of the at least one gripper.

2. The method according to claim 1, which further comprises fixing the at least one gripper to a revolving element, and additionally generating the actuating signals from signals from a rotary encoder supplying output signals reproducing a rotational position of the revolving element.

3. The method according to claim 1, which further comprises actuating the at least one gripper using at least one pneumatically controllable operating cylinder.

4. The method according to claim 1, wherein the dimensions of the fold widths are a trailing fold sheet, a leading fold sheet, or equal fold widths.

5. The method according to claim 1, further comprising using the fold width dimension for presetting a pocket stop on separating drum carrying the at least one gripper.

6. A method for controlling a feeder of a gathering-stitching machine, the method comprising the following steps:

separating folded sheets one after another from a stack of a magazine using at least one gripper;

opening and closing the at least one gripper using actuating signals from a control device; and generating the actuating signals for opening and closing the at least one gripper from data relating to dimensions and number of pages of the folded sheets, the dimensions including dimensions of fold widths of the folded sheets; and using the dimensions of the fold widths for setting a gripper closing angle of the at least one gripper.

7. The method according to claim 6, which further comprises fixing the at least one gripper to a revolving element, and additionally generating the actuating signals from signals from a rotary encoder supplying output signals reproducing a rotational position of the revolving element.

8. The method according to claim 6, which further comprises actuating the at least one gripper using at least one pneumatically controllable operating cylinder.

9. The method according to claim 6, wherein the dimensions of the fold widths are a trailing fold sheet, a leading fold sheet, or equal fold widths.

* * * * *